United States Patent [19]

Dickerson et al.

[11] 4,012,260

[45] Mar. 15, 1977

[54] ACTIVATOR-STABILIZERS IN HEAT DEVELOPABLE PHOTOGRAPHIC MATERIALS AND PROCESSES

[75] Inventors: Dorsey G. Dickerson; Paul B. Merkel, both of Rochester, N.Y.

[73] Assignee: Eastman Kodak Company, Rochester, N.Y.

[22] Filed: Feb. 19, 1975

[21] Appl. No.: 551,182

[52] U.S. Cl. ..... 96/114.1; 96/48 HD; 96/76 R; 96/94 R; 96/109; 427/56; 427/151

[51] Int. Cl.[2] ..... G03C 1/02; G03C 1/48

[58] Field of Search ..... 96/114.1, 48 HD, 76 R, 96/109, 94 R; 427/151, 56

[56] References Cited

UNITED STATES PATENTS

| | | | |
|---|---|---|---|
| 3,220,846 | 11/1965 | Tinker et al. | 96/114.1 |
| 3,392,020 | 7/1968 | Yutzy et al. | 96/114.1 X |
| 3,707,377 | 12/1972 | Tiers et al. | 96/114.1 |

*Primary Examiner*—Mayer Weinblatt

*Attorney, Agent, or Firm*—Richard E. Knapp

[57] ABSTRACT

2-Amino-2-thiazolinium carboxylates and 4,5-dihydro-6H-1,3-thiazin-3-ium carboxylates are activator-stabilizers in heat-developable and heat-stabilizable photographic materials containing photographic silver salts and photographic silver salt developing agents. An image in such a photographic material is developed and the resulting developed image is stabilized by heating the photographic material.

14 Claims, No Drawings

ACTIVATOR-STABILIZERS IN HEAT DEVELOPABLE PHOTOGRAPHIC MATERIALS AND PROCESSES

BACKGROUND OF THE INVENTION

1. Field of the Invention

This invention relates to certain carboxylates as activator-stabilizers in heat developable photographic elements, compositions and processes. In one aspect the invention relates to heat-developable photographic elements containing the described thiazolinium compounds. In another aspect it relates to photographic compositions such as photographic silver halide emulsions containing the described thiazolinium compounds. A further aspect relates to a method of developing and stabilizing an image in a heat-developable photographic material with the described thiazolinium compounds by heating the photographic material.

1. Description of the State of the Art

Heat-developable photographic materials are known. These materials are designed for so-called dry processing with heat. These materials are described, for example, in U.S. Pat. No. 3,301,678 of Humphlett, Johnson and Haist, issued Jan. 31, 1967; British Pat. No. 1,161,777 published Aug. 20, 1969; U.S. Pat. No. 3,152,904 of Sorensen et al, issued Oct. 13, 1964; British Pat. No. 1,131,108 published Oct. 23, 1968; U.S. Pat. No. 3,392,020 of Yutzy et al, issued July 9, 1968; German Pat. No. 888,045 published Aug. 27, 1953; British Pat. No. 930,572 published July 3, 1963; and U.S. Pat. No. 3,220,846 of Tinker and Sagura, issued Nov. 30, 1965.

Stabilizer precursors are also known in photographic materials for processing with heat. These are described, for example, in U.S. Pat. No. 3,301,678 of Humphlett, Johnson and Haist, issued Jan. 31, 1967. It has been the practice to incorporate a development activator or alkali-release agent which is different from the developing agent or developing agent precursor or stabilizer precursor in such photographic materials. This is described, for instance, in U.S. Pat. No. 3,041, 170 of Haist and King, issued June 26, 1962 and Belgian Pat. No. 709,967 issued Feb. 29, 1968. These photographic materials did not eliminate the need for a separate development activator and alkali-release agent.

It is further known that certain bis-isothiuronium compounds having an intermediate ureylene or ether moiety between the isothiuronium moieties can be development activators and image stabilizers in photographic materials for processing with heat. This is described in U.S. Pat. No. 3,669,670 of Haist and Humphlett, issued June 13, 1972.

Photothermographic materials incorporating isothiuronium stabilizer precursors have required higher processing temperatures than desired. They also have required larger concentrations of processing chemicals than desired and often are confined to use with photographic materials which are relatively low speed, smaller grain silver chloride and silver chlorobromide photographic materials. In many cases they also have resulted in obnoxious odors upon heat processing.

Heterocyclic thione and tautomeric thiol compounds have been used for different purposes in photographic materials. For example, certain heterocyclic sulfur compounds or their tautomeric thiols have been used in photographic silver halide materials for processing with heat. This is described, for example, in German OLS 2,162,714 published July 6, 1972. These compounds, however, have not provided the desired image with reduced processing temperatures or have not provided desired activation of the incorporated developing agent in the heat-developable photographic material.

Heterocyclic compounds such as thiazoles and thiazolines have been employed in photographic materials for other purposes, such as fixers, as described in U.S. Pat. No. 3,189,453 of Hertz and Kalenda, issued June 15, 1965.

There has been a continuing need to provide heat-developable and heat-stabilizable photographic silver halide materials and processes which enable use of lower processing temperatures, reduced concentrations of processing materials and which enable use of a wider range of silver halide photographic materials without the production of obnoxious odors upon processing with heat.

SUMMARY OF THE INVENTION

According to this invention, the described properties are provided by a stabilizing concentration of an activator-stabilizer which is a carboxylate compound selected from the group consisting of 2-amino-2-thiazolinium carboxylates, 4,5-dihydro-6H-1,3-thiazin-3-ium carboxylates, and combinations thereof, in a heat-developable and heat-stabilizable photographic material comprising a photographic silver salt, such as photographic silver halide, and a photographic silver salt developing agent or developing agent precursor. The described carboxylate activator-stabilizers according to the invention provide, upon heating, activation of a developing agent or developing agent precursor and stabilization of a developed image without significantly adversely affecting sensitometric properties of the photographic material.

DETAILED DESCRIPTION OF THE INVENTION

A range of carboxylates, as described, are useful in heat-developable and heat-stabilizable photographic materials and processes according to the invention. One useful class of carboxylate activator-stabilizers according to the invention is represented by the formula:

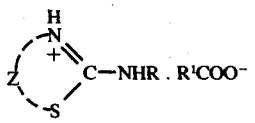

(preferred tautomeric form)

wherein

Z is alkylene, as defined herein, having 2 to 3 carbon atoms in the alkylene chain;

R is hydrogen, alkyl containing 1 to 3 carbon atoms, such as methyl, ethyl and propyl, cycloalkyl containing 5 or 6 carbon atoms such as cyclopentyl and cyclohexyl, or aralkyl containing 7 to 10 carbon atoms, such as benzyl;

$R^1COO^-$ is an acid anion which is decarboxylatable at temperatures above about 80° C., and tautomers corresponding to the described thiazolinium compounds.

The carboxylate activator-stabilizers as described herein include their tautomers.

The carboxylate anion which can be decarboxylated on heating is, for example, a trichloroacetate, cyanoacetate, beta-ketoacetate or tribromoacetate anion. Polybasic acid anions require an equivalent number of cations.

Alkyl, as defined herein includes unsubstituted alkyl and alkyl substituted with a group which does not adversely affect the desired activating and stabilizing activity of the activator-stabilizers of the invention. Such a substituent on the alkyl can be, for example, phenyl, amide, hydroxymethyl or bromomethyl.

Alkylene, as described, includes straight chain alkylene, such as $-CH_2-CH_2-$ and $-CH_2-CH_2-CH_2-$, branched chain alkylene, such as $$-CH_2-CH_2-\underset{\underset{CH_3}{|}}{CH}-,$$

and alkylene containing substituents which do not adversely affect the desired activating and stabilizing activity of the activator-stabilizers of the invention, such as phenyl, amide, hydroxymethyl and bromomethyl groups.

An especially useful activator-stabilizer is one in which Z represents an ethylene group as described to complete a thiazoline ring; R is hydrogen; and $R^1$ is a trichloromethyl group. This is 2-amino-2-thiazolinium trichloroacetate represented by the formula:

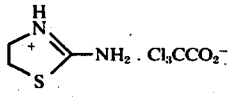

Other useful activator-stabilizers which for the purposes of this description, are considered to be carboxylates according to the invention are:

bis(2-amino-2-thiazolinium)oxalacetate
2-amino-2-thiazolinium tribromoacetate
2-amino-2-thiazolinium cyanoacetate
2-amino-5-bromomethyl-2-thiazolinium trichloroacetate
4,5-dihydro-6H-1,3-thiazin-3-ium trichloroacetate Combinations of carboxylate stabilizer precursors as described can be used if desired.

Carboxylate activator-stabilizers, as described, can be prepared by mixing the desired acid and base, such as 2-amino-2-thiazoline and trichloroacetic acid, in a minimum amount of solvent such as methanol or ethanol, and then adding sufficient solvent, such as ether, to provide desired salt precipitation. The resulting carboxylate compound can be recovered by methods known in the art, such as by filtration. The acid and base moieties are typically mixed in about stoichiometric concentrations. It is not necessary to heat the reactant mixture. The reaction is typically carried out at atmospheric pressure. The product can be purified by techniques known in the art such as recrystallization from a suitable solvent mixture such as methanol-ether.

One embodiment of the invention is: in a heat-developable and heat-stabilizable photographic element comprising a support having thereon in reactive association a photographic silver salt, typically photographic silver halide, a photographic silver salt developing agent, such as a silver halide developing agent, and an activator-stabilizer, the improvement wherein the activator-stabilizer is a carboxylate activator-stabilizer, as described herein.

A silver salt developing agent, typically a silver halide developing agent, is useful in the photographic materials and processses as described to provide a desired developed image. Useful silver salt developing agents, typically silver halide developing agents, include for example, polyhydroxybenzenes such as hydroquinone developing agents, including, for example, hydroquinone, alkyl-substituted hydroquinones such as tertiarybutylhydroquinone, methylhydroquinone, 2,5-dimethylhydroquinone and 2,6-dimethylhydroquinone; catechols and pyrolgallol; chlorohydroquinone or dichlorohydroquinone; alkoxy substituted hydroquinones such as methoxyhydroquinone or ethoxyhydroquinone; methylhydroxynaphthalene; methyl gallate; aminophenol developing agents such as 2,4-diaminophenols and methylaminophenols; ascorbic acid developing agents such as ascorbic acid, ascorbic acid ketals and ascorbic acid derivatives; hydroxylamine developing agents such as N,N-di(2-ethoxyethyl)hydroxylamine; 3-pyrazolidone developing agents such as 1-phenyl-3-pyrazolidone and 4-methyl-4-hydroxymethyl-1-phenyl-3-pyrazolidone, such as described in British Pat. No. 930,572 published July 3, 1963; hydroxytetronic acid and hydroxytetronimide developing agents; reductone developing agents, such as anhydrodihydropiperidino hexose reductone; and the like. Combinations of developing agents can be useful.

The photographic materials and compositions as described contain a photographic silver salt, preferably photographic silver halide. Useful photographic silver halides include, for example, silver chloride, silver bromide, silver bromoiodide, silver chlorobromoiodide or mixtures thereof. The photographic silver halide can be coarse or fine-grain. The composition containing the photographic silver halide can be prepared by any of the well-known procedures in the photographic art such as single-jet emulsions, double-jet emulsions, such as Lippmann emulsions, ammoniacal emulsions, thiocyanate or thioether ripened emulsions and the like such as described in U.S. Pat. No. 2,222,264 of Nietz et al, issued Nov. 14, 1940; U.S. Pat. No. 3,332,069 of Illingsworth, issued May 15, 1967 and U.S. Pat. No. 3,271,157 of McBride, issued Sept. 6, 1966. Surface image silver halide materials can be useful or internal image silver halide materials such as those described in U.S. Pat. No. 2,592,250 of Davey et al, issued Apr. 8, 1952; U.S. Pat. No. 3,206,313 of Porter et al, issued Sept. 14, 1965; U.S. Pat. No. 3,367,778 of Berriman et al, issued Feb. 6, 1968 and U.S. Pat. No. 3,447,927 of Bacon et al, issued June 3, 1969. If desired, mixtures of surface image and internal image silver halide materials can be useful as described in U.S. Pat. No. 2,996,382 of Luckey et al, issued Apr. 15, 1961. Silver halide materials useful can be regular grain silver halide materials such as the type described in Klein and Moisar, "Journal of Photographic Science," Volume 12, Number 5, September-October, 1964, pages 242–251 and German Pat. No. 2,107,118. Negative type silver halide materials can be useful as well as direct positive silver halide materials.

The silver halide photographic materials can be washed or unwashed to remove soluble salts after precipitation of the silver halide; can be chemically sensitized; can contain development modifiers that function as speed-increasing compounds; and can contain antifoggants and emulsion stabilizers; as described in the *Product Licensing Index*, Volume 92, December, 1971, publication 9232, page 7. The photographic materials according to the invention can also contain hardeners, antistatic layers, plasticizers, lubricants, coating aids, matting agents, brighteners, absorbing and filter dyes which do not adversely affect the properties of the heat-developable and heat-stabilizable materials of the invention. These addenda are described, for example, in the above Product Licensing Index publication.

The heat-developable and heat-stabilizable photographic materials as described can contain various vehicles and binders alone or in combination. Suitable vehicle materials include both naturally-occurring substances such as protein, for example, gelatin, gelatin derivatives, cellulose derivatives, polysaccharides such as dextrin, gum arabic and the like; and synthetic polymeric materials such as water soluble polyvinyl compounds like poly(vinyl pyrrolidone), acrylamide polymers and the like. The photographic layers and other layers of the elements of the invention such as overcoat layers, interlayers and subbing layers can also contain alone or in combination with the described vehicles, other synthetic polymeric vehicle compounds such as dispersed vinyl compounds, such as in latex form, and particularly those which increase the dimensional stability of the photographic materials. Useful synthetic polymers include those described in the above Product Licensing Index publication. Effective polymers include water insoluble polymers of alkylacrylates and methacrylates, acrylic acid, sulfoalkyl acrylates or methacrylates and those which have crosslinking sites which facilitate hardening or curing as well as those having recurring sulfobetaine units as described in Canadian Pat. No. 774,054 issued Dec. 19, 1967.

The photographic and other layers of an element according to the invention can be coated on a wide variety of supports. Typical supports include those which are resistant to adverse changes in structure and do not adversely affect the sensitometric properties of the described photographic materials at the processing temperatures employed. Typical supports include cellulose ester film, poly(vinyl acetal) film, poly(ethylene terephthalate) film, polycarbonate film and related films and resinous materials, as well as glass, paper, metal and the like. Typically, a flexible support is employed especially a paper support.

The photographic elements and compositions of the invention can contain spectral sensitizing dyes to conveniently confer additional sensitivity to the light sensitive silver salts, especially light sensitive silver halide materials of the invention. Useful spectral sensitizing dyes are described, for example, in the above Product Licensing Index. Combinations of these dyes can be useful if desired. In addition, supersensitizing addenda which do not absorb visible light may be useful in the described materials. The sensitizing dyes and other addenda useful in materials according to the invention can be incorporated into these materials from water solutions or suitable organic solvent solutions. The sensitizing dyes and other addenda can be added using various procedures such as described in the above Product Licensing Index publication.

The heat-developable and heat-stabilizable layers and other layers of photographic elements as described can be coated by various coating procedures. If desired, two or more layers may be coated simultaneously. These procedures for coating are described, for example, in U.S. Pat. No. 3,669,670 of Haist and Humphlett, issued June 13, 1972.

The described activator-stabilizers are useful in a range of physical locations in a photographic element according to the invention. The described activator-stabilizers are useful in one or more layers of the described photographic element such as in the silver halide composition layer and/or an overcoat layer and/or a layer between the silver salt composition layer and a support. It is necessary that the described activator-stabilizer be contiguous to the photographic silver salt to be stabilized and the developing agent or developing agent precursor to be activated. This contiguous location enables desired interaction between the photographic silver compound and the developing agent or developing agent precursor upon heating of the photographic material. The term "in association with" as employed herein is intended to mean that the compound is in such a location enabling such desired interaction.

Various saccharides can be useful in combination with the described activator-stabilizers. Useful saccharides are described, for example, in British Pat. No. 930,572 published July 3, 1963. The concentration of saccharide which is useful can vary depending upon the desired image, other components of the photographic material, the particular activator-stabilizer, processing conditions and the like. A concentration of about 0.01 to about 20 moles of saccharide per mole of described thiazolinium compound is useful.

The described activator-stabilizers are useful in a range of heat-developable and heat-stabilizable photographic compositions. Accordingly, another embodiment of the invention is a heat-developable and heat-stabilizable photographic composition comprising a photographic silver salt, typically photographic silver halide, a photographic silver salt developing agent or developing agent precursor, typically a silver halide developing agent, and a carboxylate activator-stabilizer, as described. The carboxylate activator-stabilizer is typically a 2-amino-2-thiazolinium carboxylate, as described. The photographic composition is typically a photographic silver halide emulsion.

The described activator-stabilizers are useful in photographic silver salt processing compositions such as in silver halide developers, stabilizing compositions, fixing compositions, hardeners and the like which enable use of the alkali release and stabilizer release properties of the described activator-stabilizers. For these reasons, another embodiment of the invention is a heat activatable photographic silver salt processing composition comprising a silver salt developing agent, as described, and a stabilizing concentration of an activator-stabilizer as described, such as a 2-amino-2-thiazolinium carboxylate, also as described. The stabilizing concentration most useful will depend upon several factors, such as the particular activator-stabilizer, the processing temperature, desired image and the like. A useful concentration is typically about 0.5 moles to about 6 moles of the activator-stabilizer per mole of silver salt developing agent in the photographic silver salt processing composition.

A useful heat activatable photographic silver halide processing composition within this embodiment comprises (a) a phenolic silver halide developing agent, (b) a 1-phenyl-3-pyrazolidone silver halide developing agent and (c) a stabilizing concentration of an activator-stabilizer which is a compound selected from the group consisting of 2-amino-2-thiazolinium trichloroacetate, bis(2-amino-2-thiazolinium)oxalacetate and combinations of these thiazolinium compounds.

The heat activatable photographic silver halide processing composition can comprise, for example, an ethyl cellulose binder, a stabilizing concentration of an activator-stabilizer which is 2-amino-2-thiazolinium trichloroacetate, and a combination of silver halide developing agents comprising 4-methyl-4-hydroxymethyl-1-phenyl-3-pyrazolidone and a hydroquinone silver halide developing agent.

The photographic compositions and elements as well as the photographic silver salt processing compositions according to the invention can contain a silver halide developing agent as described. The concentration of silver halide developing agent which is useful is within the range of about 0.25 mole to about 4 moles of developing agent per mole of photographic silver compound in the photographic material to be processed.

Because the described carboxylate compounds according to the invention are useful as activators for developing agents and as stabilizer precursors, no other stabilizers or stabilizer precursors are needed in the described compositions of the invention. However, other stabilizers or stabilizer precursors can be used with the photographic materials and processes of the invention if desired. For example, certain isothiuronium stabilizer precursors such as those described in U.S. Pat. No. 3,669,670 of Haist and Humphlett, issued June 13, 1972 can be useful in combination with the described activator-stabilizers. Halogen-containing stabilizer precursors such as those described in U.S. Pat. No. 3,707,377 issued Dec. 26, 1972 can also be useful in combination with the described activator-stabilizers.

After exposure of a photograhic material, according to the invention, an image in the photographic material comprising in reactive association (a) a photographic silver salt, (b) a photographic silver salt developing agent, and (c) a stabilizing concentration of an activator-stabilizer, which is a 2-amino-2-thiazolinium carboxylate, as described can be developed and stabilized by merely heating the material to a temperature within the range of about 90° C. to about 200° C. until the desired image is developed and stabilized.

An image is typically developed by heating the material to a temperature within the described range for about 1 to about 60 seconds, such as about 2 to about 10 seconds.

By increasing or decreasing the time of heating, a higher or lower temperature within the described range is useful.

Processing is usually carried out under ambient conditions of pressure and humidity. Pressures and humidity outside normal atmospheric conditions can be useful if desired; however, normal atmospheric conditions are preferred.

Various means are useful for providing the necessary heating as described. The photographic element according to the invention can be brought into contact with a simple hot plate, iron, rollers, dielectric heating means or the like.

Small concentration of moisture can be present during processing such as the concentration of moisture present in conventional photographic paper supports at atmospheric conditions, such as at about 25° C. and 40% relative humidity.

While it is not necessary, an activator, also known as an alkali-release agent, or an activator precursor, can be useful with the described thiazolinium compounds. An activator as described herein is intended to mean an agent which aids the developing agent at processing temperatures with the described thiazolinium compounds to develop a latent image in a photographic silver salt contiguous to the developing agent. Useful activators or activator precursors are described, for example, in Belgian Pat. No. 709,967 published Feb. 29, 1968. Examples of useful activators or activator precursors include guanidinium salts, such as guanidinium trichloroacetate, diguanidinium glutarate, succinate, malonate and the like; quaternary ammonium malonates such as piperazinium or piperidinium malonate; amino acids, such as 6-amino acrylic acid glycine; and the like. Other activators or activator precursors are described, for example, in British Pat. No. 998,949 published July 21, 1965.

The activator-stabilizers, as described, can be useful in light sensitive diazo type materials. The two component light sensitive diazo type materials can contain at least one light sensitive diazonium salt and at least one coupling compound which can react with the diazonium salt typically in an alkaline medium to form an azo dye. In addition, various other addenda such as ultraviolet absorbers, acid stabilizers (to prevent premature coupling of the diazonium salt and the coupler), can be present with the activator-stabilizers as described. A diazo type element containing the described activator-stabilizer can be imagewise exposed to activating radiation through an original. The impending light decomposes the diazonium salt. Thereafter, development of the exposed diazo type material can be accomplished by treatment with an alkaline medium. In lieu of externally supplied alkaline medium, such as ammonia, the described activator-stabilizers are useful incorporated into the diazo type materials as alkaline releasing development precursors. The activator-stabilizers as described when heated, such as up to about 130° C., generate alkaline material useful for initiating the coupling reaction in the diazo type material. Simple heating produces desired image development without requiring an outside source of ammonia or other alkaline material. An example of a diazo type material according to this embodiment comprises a water soluble cellulose acetate binder, cyclohexosulfonic acid, para-diazodiethylaniline zinc chloride, 6,7-dihydroxy-2-naphthalene sodium sulfonate, a surfactant, and a compound selected from the group consisting of 2-amino-2-thiazolinium trichloroacetate, bis(2-amino-2-thiazolinium)oxalacetate, and combinations of these compounds. This material is coated on a polyester film support at a desired wet thickness. After drying, the resulting photographic material can be exposed imagewise to ultraviolet radiation until the diazonium salt is decomposed in the light-struck areas. The exposed element can then be overall heated at a temperature up to about 200° C. for a period of time to provide a developed dye image.

The concentration of the described activator-stabilizer which is useful in the photographic materials, according to the invention, can vary depending upon such factors as the desired image, processing conditions, particular activator-stabilizer, and the like. A concentration range of activator-stabilizer in a photographic element or composition as described is typically about 0.5 to about 6 moles of the activator-stabilizer per mole of photographic silver salt in the element or composition.

The following examples are included for a further understanding of the invention.

EXAMPLE 1

The following materials were mixed:

| | |
|---|---|
| ethyl cellulose | 200 mg |
| 2-amino-2-thiazolinium trichloroacetate | 500 mg |
| 4-methyl-4-hydroxymethyl-1-phenyl-3-pyrazolidone | 10 mg |
| methanol | 10 ml |
| hydroquinone | 100 mg |

The resulting composition was coated on a silver chloride gelatino emulsion layer on a gelatin-subbed paper support. The silver chloride emulsion layer contained 30 mg per 929 square centimeters of support of the silver chloride gelatino emulsion. The composition containing the hydroquinone was coated at a wet coating thickness of 4 mils. Samples of the heat-developable and heat-stabilizable element were sensitometrically exposed to provide a developable latent image in the element. The element was then heated at 130°–160° C. for 10 seconds at 10° C. intervals. Images were developed and stabilized in each sample. The images produced were brownish in the maximum density areas and green and gold in the middle-tone areas. The developed images provided no change in sensitometric properties or hue following exposure of the samples to 2,000 foot candle hours of room light. The developed images had a maximum density of 1.0 and a minimum density of 0.20.

The samples were held for one week prior to processing in black paper envelopes at about 38° C. and 50% relative humidity for one week. The resulting processed samples had no substantial change in sensitometric properties or hue change after this incubation period.

The following components were mixed:

| | |
|---|---|
| gelatin | 200 mg |
| surfactant (Surfactant 10G which is an alkylphenoxypolyglycidol sold by Olin Corporation, U.S.A.) | 10 mg |
| 2-amino-2-thiazolinium trichloroacetate | 500 mg |
| 4-methyl-4-hydroxymethyl-1-phenyl-3-pyrazolidone | 100 mg |
| silver bromoiodide gelatino emulsion 2.5 mole % iodide, 0.09 micron silver bromoiodide) | 100 mg (silver) |
| water | up to 10 ml |

EXAMPLE 2

The resulting composition was coated on a poly(ethyleneterephthalate) film support at a wet coating thickness of 4 mils at about 50° to about 55° C. The coating was dried by passing hot air over it. Samples of the resulting heat-developable and heat-stabilizable photographic element were sensitometrically exposed to provide a developable latent image and then heat processed by heating the samples at 140° to 160° C. for 10 seconds. A developed image was produced in the samples.

The samples were kept in black paper envelopes at about 48° C. at ambient relative humidity for 2 weeks. The resulting samples illustrated no significant change in sensitometric properties or hue changes. The processed samples were exposed to 2,000 foot candle hours of light. Image tone was brownish green in color by light reflection and deep purple by light transmission. The images had a maximum density of 2.3 and a minimum density of 0.1.

EXAMPLE 3

The procedures described in Example 2 were repeated using chloride, bromide and bromoiodide gelatino emulsions having grain size varying from 0.09 microns to 0.80 microns, and with and without different types of chemical sensitization of the silver halide. In each instance a developed image resulted. A silver bromide having an average grain size of 0.09 microns and no chemical sensitization provided a maximum density of 2.16 and a minimum density of 0.09 and a gamma of 4.5 before incubation. After incubation at about 50° C. at about 50% relative humidity the maximum density was 1.76 which was not considered to be a significant loss of maximum density.

The results indicated that the maximum density, minimum density, gamma and photographic speed varied depending upon such factors as the type of halide in the photographic silver halide, the grain size of the photographic silver halide and the type of chemical sensitization of the silver halide.

EXAMPLE 4

The procedures of Example 1 were repeated with the exception that the ethyl cellulose was replaced by one of the following synthetic polymers with the observed results:

| Polymer | Observed Results |
|---|---|
| (Control) ethyl cellulose | minimum density was 0.20 |
| copolymer of acrylamide and 2-acetylethoxyethylmethacrylate (200 mg) | brown-black tone image developed |
| poly(vinyl alcohol) (from 1:1 methanol-water) | purple tone image developed |
| copolymer of N-isopropylacrylamide and acrylamide and 2-acetoacetoxyethylmethacrylate | purple tone image developed |

Each of the heat-developable and heat-stabilizable photographic elements provided a maximum density value of about 1.00 and each exhibited some loss of maximum density, about 0.30 to about 0.40 loss in maximum density, after one-day pre-process incubation at about 50° C. at ambient relative humidity. The heat-developable and heat-stabilizable photographic element of Example 1, on the other hand, containing ethyl cellulose illustrated no significant change in the maximum density under the same test conditions.

EXAMPLE 5

This is a comparative example.

The procedures of Example 2 were repeated with the exception that no 2-amino-2-thiazolinium trichloroacetate was present in the photographic element prior to imagewise exposure and thermal processing. The photograhic element after the imagewise exposure as described in Example 2 upon thermal processing provided almost no developed image and upon exposure to room light immediately began to printup in the background areas. Within a few minutes the overall density of the photographic element in room light was in excess of 2.0.

EXAMPLE 6

The procedures of Example 2 were repeated with the exception that 600 milligrams of bis(2-amino-2-thiazolinium) oxalacetate represented by the formula:

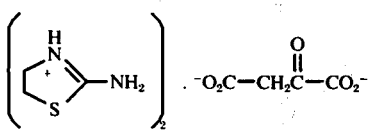

were used in place of 2-amino-2-thiazolinium trichloroacetate in the heat-developable and heat-stabilizable photographic element described. Upon imagewise exposure as described in Example 2 and development of the image by heating the element at 150° C. for 10 seconds, the developed image had a maximum density of 1.3 and a minimum density of 0.2. The developed image had the same tone as observed for the image developed in the photographic element of Example 2. The image developed in the photographic element was stable to 1,000 foot candle hours of illumination. The keeping stability of this element, however, may be less than desired.

A barrier layer can be useful in a photothermographic element as described. A development activator can be separated from another layer of a photothermographic element by a barrier layer, for example. A typical format for such a photothermographic element is as follows:

| | |
|---|---|
| 1. | photothermographic layer |
| 2. | barrier layer |
| 3. | activator layer |
| 4. | support |

wherein layer 1. is a photothermographic layer containing photographic silver halide, an incorporated silver halide developing agent and other addenda in a suitable binder; layer 2. is a barrier layer, such as a hydrophobic, polymeric barrier layer; and layer 3. is a layer containing a development activator, such as an activator-stabilizer as described herein; and 4. is a support for the element. Upon heating, the development activator diffuses through the barrier layer 2. into layer 1. The activator in layer 1. can initiate development in the photothermographic layer. An amine activator, such as 2-amino-2-thiazoline, can be coated in a poly(vinyl alcohol) binder on a poly(ethylene terephthalate) film support. A barrier layer comprising, for example, a hydrophobic polymer such as poly(vinyl butyral), polystyrene or poly(methyl methacrylate), can be coated on the activator containing layer. Then a photothermographic layer is coated on the barrier layer. The photothermographic layer can contain, for instance, photographic silver bromoiodide in gelatin and 4-methyl-4-hydroxymethyl-1-phenyl-3-pyrazolidone as a developer.

The invention has been described in detail with particular reference to preferred embodiments thereof, but it will be understood that variations and modifications can be effected within the spirit and scope of the invention.

What is claimed is:

1. A heat-developable and heat-stabilizable photographic element comprising a support having thereon in reactive association a photographic silver salt, a photographic silver salt developing agent and a stabilizing concentration of an activator-stabilizer represented by the formula:

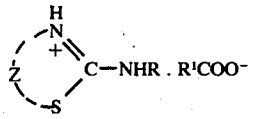

wherein

Z is alkylene having 2 to 3 carbon atoms in the alkylene chain,

R is hydrogen, alkyl containing 1 to 3 carbon atoms, cycloalkyl containing 5 to 6 carbon atoms, or aralkyl containing 7 to 10 carbon atoms, $R^1COO^-$ is an acid anion which is decarboxylatable at temperatures above about 80° C., and tautomers corresponding to said activator-stabilizer.

2. A heat-developable and heat-stabilizable photographic element as in claim 1 wherein said activator-stabilizer is a compound selected from the group consisting of 2-amino-2-thiazolinium trichloroacetate, bis(2-amino-2-thiazolinium)oxalacetate, and combinations of these thiazolinium compounds.

3. A heat-developable and heat-stabilizable photographic element comprising a support having thereon in reactive association a photographic silver salt, a photographic silver salt developing agent and a stabilizing concentration of an activator-stabilizer which is a carboxylate selected from the group consisting of 2-amino-2-thiazolinium carboxylates, 4,5-dihydro-6H-1,3-thiazin-3-ium carboxylates and combinations thereof.

4. A heat-developable and heat-stabilizable photographic element comprising a support having thereon a layer comprising photographic silver halide, a polymeric binder, a silver halide developing agent, and a stabilizing concentration of an activator-stabilizer comprising 2-amino-2-thiazolinium trichloroacetate.

5. A heat-developable and heat-stabilizable photographic composition comprising a photographic silver salt, a photographic silver salt developing agent, and a stabilizing concentration of an activator-stabilizer which is a 2-amino-2-thiazolinium carboxylate.

6. A heat-developable and heat-stabilizable photographic composition comprising a photographic silver salt, a photographic silver salt developing agent and a stabilizing concentration of an activator-stabilizer represented by the formula:

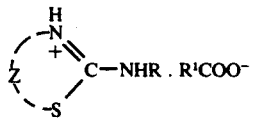

wherein

Z is alkylene having 2 to 3 carbon atoms in the alkylene chain,

R is hydrogen, alkyl containing 1 to 3 carbon atoms, cycloalkyl containing 5 to 6 carbon atoms, or aralkyl containing 7 to 10 carbon atoms, $R^1COO^-$ is an acid anion which is decarboxylatable at temperatures above 80° C. and tautomers corresponding to said activator-stabilizer.

7. A heat-developable and heat-stabilizable photographic composition as in claim 6 wherein said activator-stabilizer is a compound selected from the group consisting of 2-amino-2-thiazolinium trichloroacetate, bis(2-amino-2-thiazolinium)oxalacetate, and combinations of these thiazolinium compounds.

8. A heat-developable and heat-stabilizable photographic composition comprising photographic silver halide, a polymeric binder, a silver halide developing agent, and a stabilizing concentration of an activator-stabilizer comprising 2-amino-2-thiazolinium trichloroacetate.

9. A heat-activatable photographic silver salt processing composition comprising a silver salt developing agent and a stabilizing concentration of an activator-stabilizer which is a 2-amino-2-thiazolinium carboxylate.

10. A heat-activatable photographic silver halide processing composition comprising a phenolic silver halide developing agent, a 1-phenyl-3-pyrazolidone silver halide developing agent and a stabilizing concentration of an activator-stabilizer which is a compound selected from the group consisting of 2-amino-2-thiazolinium trichloroacetate, bis(2-amino-2-thiazolinium)oxalacetate and combinations thereof.

11. A heat-activatable photographic silver halide processing composition comprising an ethyl cellulose binder, a stabilizing concentration of an activator-stabilizer which is 2-amino-2-thiazolinium trichloroacetate, and a combination of silver halide developing agents comprising 4-methyl-4-hydroxymethyl-1-phenyl-3-pyrazolidone and a hydroquinone silver halide developing agent.

12. A method of developing and stabilizing an image in a heat-developable and heat-stabilizable photographic element as defined in claim 1 comprising heating said element to a temperature within the range of about 90° C. to about 200° C. for about 1 to about 60 seconds.

13. A method of developing and stabilizing an image in a heat-developable and heat-stabilizable photographic element comprising a support having thereon a layer comprising photographic silver halide, a polymeric binder, a silver halide developing agent and a stabilizing concentration of an activator-stabilizer which is a compound selected from the group consisting of 2-amino-2-thiazolinium trichloroacetate, bis(2-amino-2-thiazolinium)oxalacetate, and combinations of these thiazolinium compounds, comprising heating said element to a temperature within the range of about 90° C. to about 160° C. for about 1 to about 4 seconds.

14. A method of developing and stabilizing an image in a photographic element comprising a support having thereon in reactive association a photographic silver salt, a photographic silver salt developing agent, and a stabilizing concentration of an activator-stabilizer which is a carboxylate selected from the group consisting of 2-amino-2-thiazolinium carboxylates, 4,5-dihydro-6H-1,3-thiazin-3-ium carboxylates and combinations thereof comprising heating said element to a temperature within the range of about 90° C. to about 200° C. for about 1 to about 60 seconds.

* * * * *